United States Patent [19]

Stalter et al.

[11] 4,148,855

[45] Apr. 10, 1979

[54] METHOD OF MOLDING A FOAMED MATTRESS HAVING A CROWN AREA WITH CORED-OUT AREAS

[75] Inventors: Robert J. Stalter, Bowling Green; Theodore B. Burkholder, Perrysburg, both of Ohio

[73] Assignee: The Goodyear Tire & Rubber Company, Akron, Ohio

[21] Appl. No.: 849,139

[22] Filed: Nov. 7, 1977

Related U.S. Application Data

[62] Division of Ser. No. 678,011, Apr. 19, 1976, Pat. No. 4,073,020.

[51] Int. Cl.[2] ..... B29D 27/04

[52] U.S. Cl. ..... 264/54; 264/45.1; 264/293; 264/331

[58] Field of Search ..... 264/50, 45.1, 54, 331, 264/293

[56] References Cited

U.S. PATENT DOCUMENTS

| | | | |
|---|---|---|---|
| 2,145,731 | 1/1939 | Minor | 264/50 |
| 2,785,739 | 3/1957 | McGregor et al. | 5/361 B |
| 3,393,259 | 7/1968 | Trogdon | 264/45.1 |
| 3,927,162 | 12/1975 | Stalter | 264/51 |
| 4,073,839 | 2/1978 | Burkholder et al. | 264/45.1 |

FOREIGN PATENT DOCUMENTS

| | | | |
|---|---|---|---|
| 784047 | 10/1957 | United Kingdom | 5/355 |

*Primary Examiner*—Philip Anderson
*Attorney, Agent, or Firm*—J. D. Wolfe

[57] ABSTRACT

A process for casting a foamed mattress having a crown area with cored-out areas therein to modify the harshness of feel of said mattress. A mold cavity having gates therein to give the cored-out pattern in the crown of the mattress is provided and a liquid foamable urethane resin reaction mixture is deposited and distributed in a fan-shaped arc in the cavity from preferably two or more distributing beads in response to the relative movement of the depositing and distributing means to that of the mold. The deposited mixture is then permitted to foam in order to fill the mold and to their cure prior to removing the product from the mold cavity.

2 Claims, 3 Drawing Figures

METHOD OF MOLDING A FOAMED MATTRESS HAVING A CROWN AREA WITH CORED-OUT AREAS

This is a division of application Ser. No. 678,011, filed Apr. 19, 1976 now U.S. Pat. No. 4,073,020.

This invention relates generally to the manufacture of a cushion. More particularly, it relates to the manufacture of a high comfort mattress having a smartly tailored look.

The foam rubber or plastic cushion generally has a foam core with a cover thereon or enclosed therein. These foam rubber or plastic cushions and especially those made from polyurethane foam have a feeling of hardness when the load is low, such as when the cushion is first encountered by the body. Thus, when sitting down or lying down on such a cushion or mattress, the occupant has the sensation of first encountering a hard shell and then suddenly breaking through. This sensation can be varied by changing the density of the foam but this effects the comfort factor after the initial encounter.

It is accordingly an object of this invention to provide a novel method of manufacturing a mattress construction of foam which is of light weight and yet constitutes a medium on which one can rest with comfort and without the above-mentioned physical sensations.

Further objects and advantages of this invention can be seen more readily by reference to the drawings wherein FIG. 1 is a perspective view of a mattress;

Figure 2:
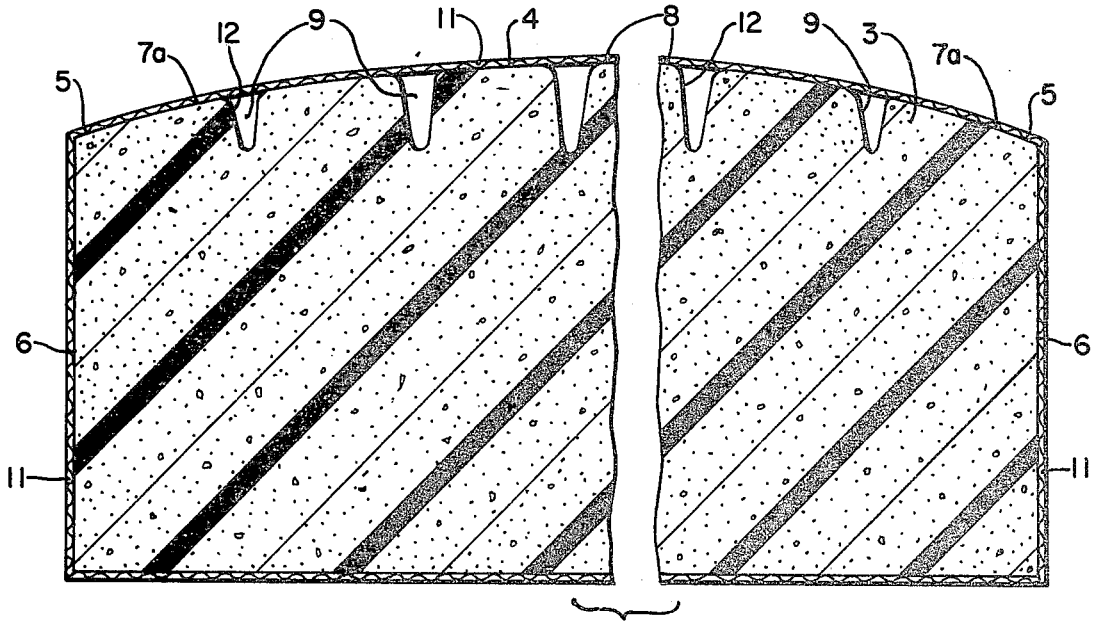
FIG. 2 is a cross-sectional view along lines 2—2 of the mattress when enclosed in a cover.

Referring to FIG. 2, the rectangular foam mattress 3 of the crown type is enclosed in a decorative mattress cover and the crown 4 of the mattress rises in the normal manner to give a gradual slope upward of one to about 10 degrees from the corner 5 of the longitudinal edges 6 of the mattress to the center thereof. The depth, length and width of the mattress is more or less conventional, depending on whether the mattress is for a single, double or king size bed.

Figure 1:
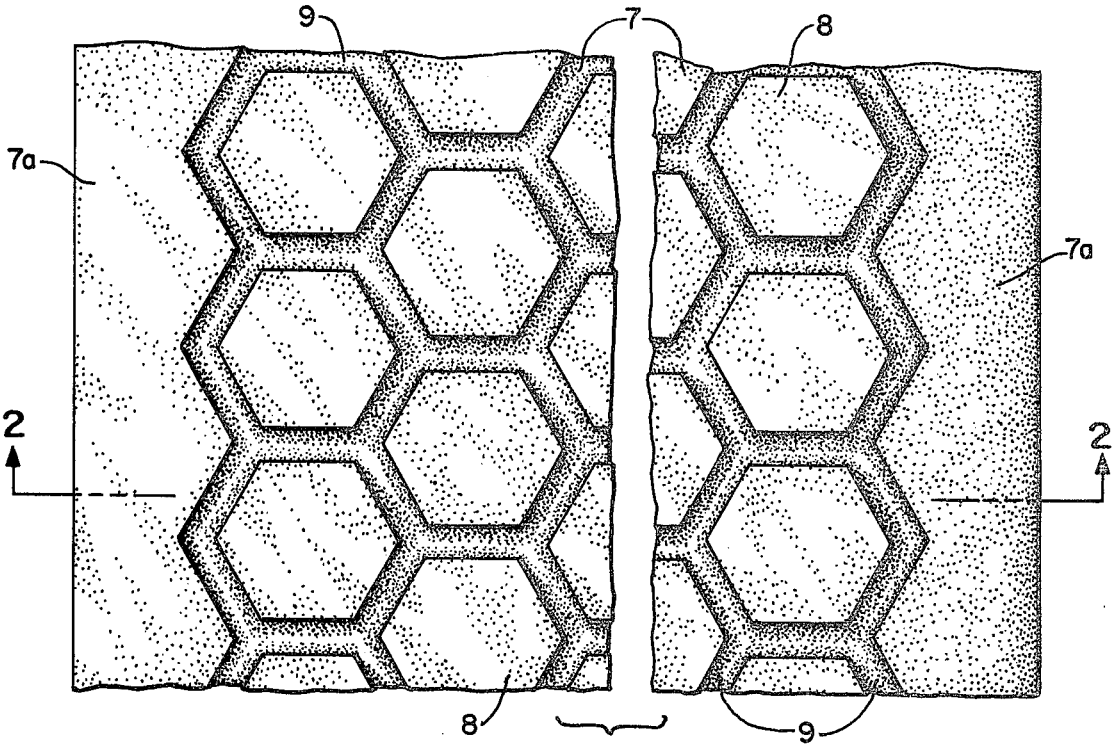

The perspective view of FIG. 1 shows the center portion 7 lying between the border strips 7A in the top portion 8 of the mattress which has a series of interconnected grooves creating a hexagonal pattern 9 therein. These interconnected grooves begin about one to eight inches and preferably three inches from the longitudinal edges 5 to leave a border strip 7A between the edge and the grooves. This arrangement of the grooves in the top portion of the core gives the mattress added strength in the outer edges and reduces the tendency to roll off the mattress due to the crown effect. Also, the hexagonal pattern of the grooves prevents the cover 11 of the mattress from tucking into the grooves and presenting an unsightly appearance of the cover over or enclosing the foam pad. Furthermore, when the diagonal grooves run at a bias to the border strips, they give the mattress a unique appearance and avoid the weight of two people lying on the mattress being concentrated in the same horizontal row.

Preferably the grooves have a tapered or V-shape 12, as seen best in FIG. 2. For instance, the grooves preferably are one and one-fourth inches deep and vary from about five-sixteenths to about nine-sixteenths inch wide at the top of the mattress to about one-sixteenth to about three-sixteenths inch at the bottom of the groove. Also, the hexagonal figures are preferably one to seven-sixteenths inch on a side. In general, it is desired that the length of the grooves in the groove pattern in the crown portion of the foam core be in short nonparallel lengths which are continuous for no more than four inches and preferably one to two inches before the groove changes directions. Thus, where the grooves run in short lengths before changing directions, the noncored-out portion can yield readily to loading to give a soft feel initially and as the raised portions are compressed can progressively resist compression to give a mattress having the ability to fit the body contour and giving a very pleasing feeling and yet the cover has a pleasing appearance.

As the number of sides to the raised portions increases it becomes a circle and in some aspects a nested circular pattern resists the cover tucking into the cored-out grooves as well as the hexagonal pattern. The grooves can describe any geometric pattern so long as they intersect and the straight lengths are less than four inches and the noncored or raised area can be deflected initially as independent units.

EXAMPLE

Figure 3:
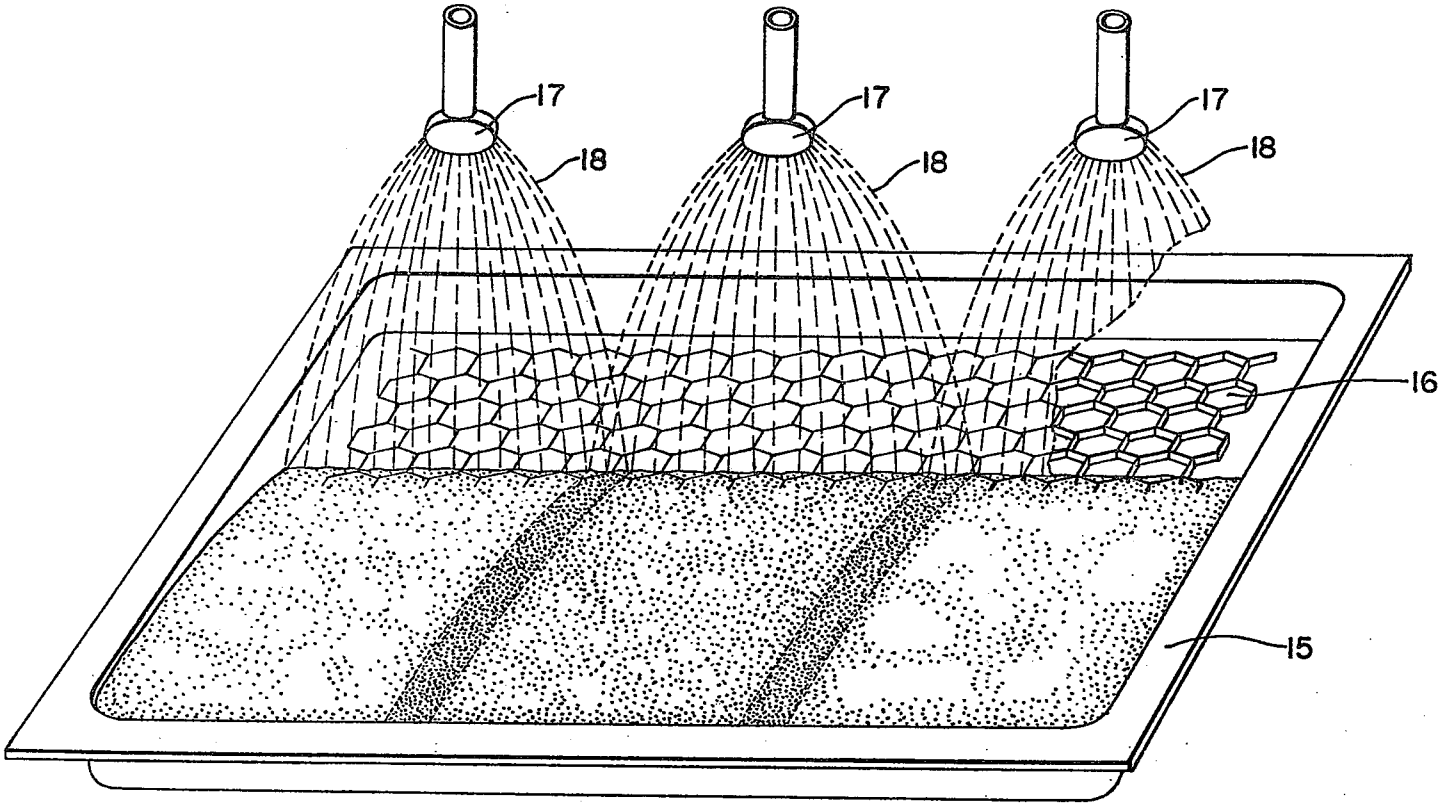
FIG. 3 is a perspective view of the mold with the mattress being poured therein using three pouring heads capable of pouring a fan-shaped pattern.

A mattress mold 15 of rectangular shape fitted with raised members or gates 16 to give a hexagonal cored out or grooved effect in the crown area was used to cast a mattress. The mattress was poured by the pouring head 17 that gives a fan-shaped pour pattern 18. Preferably two or more pouring heads are utilized as necessary dependent on the size of the article, that can pour a fan-shaped pattern. In FIG. 3 three pouring heads are shown, each head being of the type described in U.S. Pat. No. 3,927,162. These three pouring heads pour a fan-shaped pattern that yields a crown-shaped mattress having the desired hexagonal grooved pattern with no air entrapment or large bubbles obtained with other pouring heads.

Once the polyurethane foamable reaction mixture of polyether polyol and an organic polyisocyanate and sufficient water to give a foam preferably of 2.5 to 3.5 density is poured into the mold, it is closed with a suitable lid. The foamable reaction mixture is allowed to foam and cure before the mattress core is stripped from the mold. The mattress core has a geometric pattern of grooves or cored-out areas having lengths no more than about four inches before it terminates or changes directions. Thus, the noncored-out portion of the crown area can be compressed individually for at least 10 percent of its height before adjacent noncored-out areas begin to deflect.

This method of making a foam mattress permits it to be made with relatively high crowns, usually one-half to one inch in the center, without the person lying on the mattress feeling he is rolling off of it.

To recapitulate, this method of making the mattress core comprises effecting relative movement between a pour means, preferably two or more pour heads, and a mold having a cavity with a mattress crown configuration in the bottom thereof. This curvature of the cavity to achieve the mattress crown configuration is divided by suitable gates or raised portions to give a cored-out pattern in the crown of the molded product, for instance, a series of truncated pyramids or hexagonal members. The polyurethane mattress type foam reaction mixture is distributed in a fan-shaped arc in response to the relative movement between the pouring means and the mold to distribute the mixture from one end and over the gates to the other end of the mold. This relative movement may be achieved by manually moving the mold or the pouring means relative to each other or by apparatus such as described in U.S. Pat. No. 3,247,295 of J. E. Burwell. After the foamable liquid polyurethane reaction mixture of the mattress grade is distributed over the mold the mold is closed and the mixture allowed to foam full and cure within the mold before removing the molded core from the mold.

While certain representative embodiments and details have been shown for the purpose of illustrating the invention, it will be apparent to those skilled in this art that various changes and modifications may be made therein without departing from the spirit or scope of the invention.

What is claimed is:

1. A method for making a mattress core comprising effecting relative movement between a pour means and a mold having a cavity with a mattress crown configuration in the bottom thereof, said cavity containing gates to give a cored-out pattern in said crown, distributing in a fan-shaped arc a foamable liquid polyurethane reaction mixture in response to the relative movement between the pouring means and the mold to distribute the mixture from one end and over the gates to the other end of the mold, allowing the mixture to foam and fill the mold and cure before removing said core from the mold.

2. The method of claim 1 wherein the cavity of the mold contains gates that vary in depth from about 0.5 to about 2 inches.

* * * * *